US008584316B2

(12) United States Patent
Salice

(10) Patent No.: US 8,584,316 B2
(45) Date of Patent: Nov. 19, 2013

(54) HINGE FOR FURNITURE EQUIPPED WITH A ROTATING DECELERATION DEVICE

(75) Inventor: Luciano Salice, Carimate (IT)

(73) Assignee: Arturo Salice S.p.A. (IT)

( * ) Notice: Subject to any disclaimer, the term of this patent is extended or adjusted under 35 U.S.C. 154(b) by 38 days.

(21) Appl. No.: 13/399,370

(22) Filed: Feb. 17, 2012

(65) Prior Publication Data

US 2013/0042431 A1 Feb. 21, 2013

(30) Foreign Application Priority Data

Mar. 7, 2011 (IT) ..... MI2011A 000351

(51) Int. Cl.
*E05F 3/20* (2006.01)

(52) U.S. Cl.
USPC ..... 16/50; 16/70

(58) Field of Classification Search
USPC ..... 16/50, 57–58, 60, 70, 72, 75, 80, 85, 16/273, 277, 286
See application file for complete search history.

(56) References Cited

U.S. PATENT DOCUMENTS

| | | | | |
|---|---|---|---|---|
| 4,449,269 | A * | 5/1984 | Sundermeier et al. | 16/50 |
| 7,096,535 | B2 * | 8/2006 | Lin | 16/287 |
| 7,275,284 | B2 * | 10/2007 | Lautenschlager et al. | 16/287 |
| 7,562,416 | B2 * | 7/2009 | Lautenschlager et al. | 16/286 |
| 7,669,285 | B2 * | 3/2010 | Gallasch et al. | 16/286 |
| 2002/0046441 | A1 * | 4/2002 | Brustle | 16/254 |
| 2007/0157429 | A1 * | 7/2007 | Gallasch et al. | 16/238 |

* cited by examiner

*Primary Examiner* — Roberta Delisle
(74) *Attorney, Agent, or Firm* — Amster, Rothstein & Ebenstein LLP

(57) ABSTRACT

The hinge (1) for furniture comprises at least one deceleration device attached to the outside of the hinge box (4), an actuating lever (12) for the deceleration device, supported in oscillating fashion in the hinge box (4), and elastic return means to bring the actuating lever (12) back to an initial position, the deceleration device comprising a housing body (15) which extends peripherally along a side wall (9) of the box (4) and has means for fixing it to the side wall (9), the elastic return means being located on the housing body (15) outside the box (4) and providing at least one elastic arm (16) which protrudes into the inside of the box (4) through an aperture (17) in the side wall (9) of the box (4) to connect operatively with the actuating lever (12).

14 Claims, 4 Drawing Sheets

HINGE FOR FURNITURE EQUIPPED WITH A ROTATING DECELERATION DEVICE

The present invention refers to a hinge for furniture equipped with a rotating deceleration device, in particular a hinge for articles of furniture which are provided with a front frame for fixing the hinge.

In the field of furniture, the use is known of hinges to support doors of articles of furniture in oscillating fashion.

Such hinges comprise a fixed part connectable to the body of the article of furniture and a movable part, consisting of a box, connectable to the door.

In order to control and slow down the movement of the door in proximity to its closing position, the hinges can be provided with a suitable deceleration device positionable for example inside or outside the box of the hinge, depending on the configuration of the hinge and the space available in the box of the hinge.

In the particular case of furniture with a frontal frame for fixing hinges, the hinges themselves preferentially require the box to be connected to an arm of the fixed part of the hinge by means of a single rotation pin. In this case, for the relative movement of the box and the arm of the fixed part which enters it in the closed position of the hinge, the use of decelerators actuated by a slider inside the box is very awkward.

Furthermore, it is sometimes impossible to position the deceleration device inside the box, because of the space taken up by other functional parts of the hinge, such as for example specific types of closure spring, which are located inside the box itself.

The technical task which the present invention sets itself is, therefore, to make a hinge equipped with a rotating deceleration device which enables the technical disadvantages complained of in the known art to be eliminated.

Within the scope of this technical task, an object of the invention is to make a hinge equipped with a rotating deceleration device which, while involving the minimum possible total space and minimum possible number of components located inside the hinge box, is capable of exerting a strong braking action.

Another object of the invention is to make a hinge equipped with a rotating deceleration device which is capable of exerting its braking action over a sufficiently wide angle of oscillation in proximity to its closing position to ensure a satisfactory but at the same time homogeneous braking action.

Not the least of the objects of the invention is to make a hinge equipped with a rotating deceleration device that is easy to attach.

The technical task, as well as these and other objects, according to the present invention, are achieved by making a hinge for furniture having at least one deceleration device attached to the outside of the box of the hinge, an actuating lever for the deceleration device, supported in oscillating fashion in the box of the hinge, and elastic return means to bring the actuating lever back to an initial position, characterized in that the deceleration device comprises a housing body which extends peripherally along a side wall of the box and has means for fixing it to said side wall, said elastic return means being located on said housing body outside said box and providing at least one elastic arm which protrudes into the inside of the box through an aperture in the side wall of the box to connect operatively with said actuating lever.

Preferably the deceleration device comprises a rotor operatively connected with the actuating lever, said rotor having a plurality of concentric cylindrical friction surfaces engaged and cooperating with corresponding cylindrical friction surfaces in said housing body by means of a viscous fluid interposed between said friction surfaces.

Preferably the deceleration device comprises a connecting pin between said rotor and the actuating lever, said actuating lever, said connecting pin and said rotor having a common axis of oscillation.

Preferably said common axis of oscillation is parallel to the axis of oscillation of the hinge.

Preferably said connecting pin has a shaped head which is extended inside the box through a further aperture in said side wall of the box and engages with said actuating lever, and a cylindrical body housed in a cylindrical hole in said rotor concentric with said friction surfaces.

Preferably said actuating lever comprises a crosspiece featuring, at at least one of its ends a perpendicular side arm having a hole for coupling to said connecting pin.

Preferably said actuating lever is oscillatable between said initial position assumed when the hinge is in the opening position, in which said actuating lever is oriented transversely to the bottom of the box, and a final position assumed when the hinge is in the closing position, in which said actuating lever, as a result of the interaction with the fixed arm of the hinge, is located substantially parallel to the bottom of the box.

Preferably said elastic means comprise a torsion spring supported by a pin present on the housing body.

Preferably said torsion spring features said elastic arm engaged with a longitudinal edge of said crosspiece.

Preferably said fixing comprise a hole for engaging an oscillation pin for the hinge.

Preferably said deceleration device comprises coupling means between said connecting pin and said rotor, configured in such a way as to transmit the oscillation from the connecting pin to the rotor only during the oscillation of the hinge in closure.

Preferably said coupling means comprise a helical spring wound round said connecting pin and constrained at one of its ends to said rotor, said helical spring having turns lockable by friction onto the connecting pin or respectively releasable depending on the direction of oscillation, so as to Obtain the transmission of movement to the rotor only in the hinge's closing direction.

Preferably, inside the box there is housed, in a position interposed between the crosspiece and the bottom of the box, a leaf spring suitable for stressing the hinge towards the closing position.

Further characteristics and advantages of the invention will become more evident from the description of a preferred, but not exclusive, embodiment of the hinge for furniture according to the invention, illustrated by way of indication but without limiting effect, in the attached drawings, in which.

Figure 1:
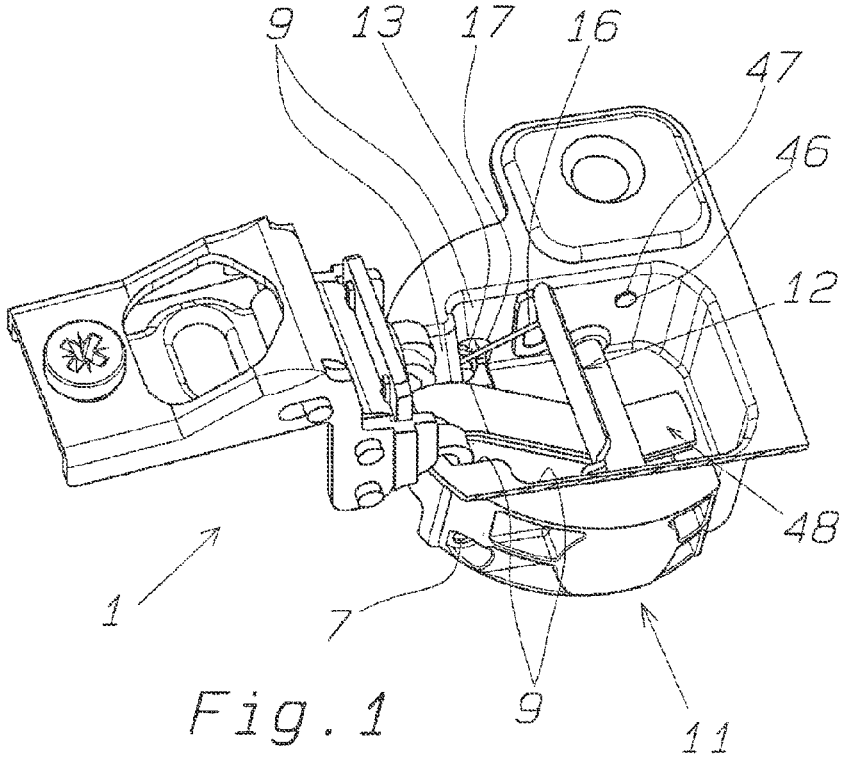
FIG. 1 shows a partially sectioned perspective view of the hinge, featuring the deceleration device according to the invention.
Figure 2:
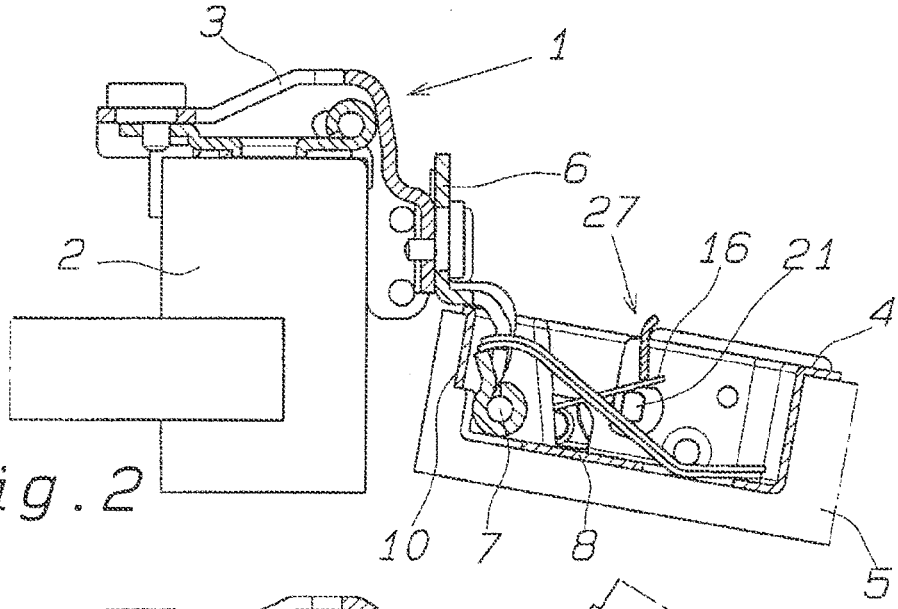
FIG. 2 shows a view in section of the hinge of FIG. 1 in the position where the door is completely open.

With reference to the mentioned drawings, a hinge 1 is shown particularly for an article of furniture in which the fixed part of the article of furniture features a front frame 2 for fixing the hinge 1.

The hinge 1 features a fixed arm, suitable for being attached to the front frame 2, and a box 4 suitable for being attached to the oscillatable part of the article of furniture 5, for example a door.

The fixed arm has a first portion 3, suitable for fitting over the thickness of the front frame 2, and a second portion 6, perpendicular to the first portion 3, suitable for being located forward of the front surface of the front frame 2.

The box 4 is pivoted on the second portion 6 of the fixed arm of the hinge by means of an oscillation pin 7 positioned in proximity to the corner between the bottom 8 of the box 4 and a side wall 10 of the box 4.

The oscillation pin 7 is oriented parallel to the bottom 8 of the box 4 and has its ends located through respective holes (not illustrated) in mutually facing side walls 9 of the box 4.

In the application shown, the hinge 1 features the single oscillation pin 7 which, once the hinge 1 is attached to the article of furniture, has a vertical orientation.

The hinge 1 comprises at least one deceleration device 11 attached to the outside of the box 4, an actuating lever 12 for the deceleration device 11, supported in oscillating fashion in the box 4, and elastic return means to bring the actuating lever 12 back to an initial position.

The deceleration device 11 comprises a housing body 15 which extends peripherally along the side wall 9 of the box 4 and has means for fixing it to the side wall 9.

The elastic return means, comprising preferentially at least one torsion spring e located on the housing body 15 outside the box 4 and provide at least one elastic arm 16 which protrudes into the inside of the box 4 through an aperture 17 in the side wall 9 of the box 4 to connect operatively with said actuating lever 12.

Specifically, the hinge 1 preferentially comprises two deceleration devices 11, each extending peripherally along a corresponding lateral wall of the box 4.

Each deceleration device 11 comprises a corresponding torsion spring 13 and both the deceleration devices 11 are actuatable by the same actuating lever 12.

The deceleration device 11 comprises a rotor 18 operatively connected with the actuating lever 12 and having a plurality of concentric cylindrical friction surfaces 19 engaged and cooperating with corresponding cylindrical friction surfaces 20 of the housing body 15 by means of a viscous fluid interposed between the friction surfaces 19 and 20.

The deceleration device 11 comprises furthermore a connecting pin 21 between the rotor 18 and the actuating lever 12.

The connecting pin 21 features a shaped head 23 and a cylindrical body 24.

The shaped head 23 of the connecting pin 21 is extended into the inside of the box 4 through a further aperture 25 in the side wall 9 of the box 4 and engages in fixed manner with the actuating lever 12.

The cylindrical body 24 of the connecting pin 21 is housed in a cylindrical hole 26 in the rotor 18 and is concentric with the friction surfaces 19 of the latter.

The actuating lever 12, the connecting pin 21 and the rotor 18 have a common axis of oscillation 22.

The axis of oscillation 22 is parallel to the axis of oscillation of the hinge 1 defined by the oscillation pin 7 and is positioned substantially centrally in the box 4 at a greater distance from the bottom 8 of the box 4 than that of the axis of oscillation of the hinge 1.

The deceleration device comprises coupling means between the connecting pin 21 and the rotor 18 configured in such a way as to transmit the oscillation from the connecting pin 21 to the rotor 18 only during the oscillation of the door in closure.

The actuating lever 12 in fact is oscillatable integrally with the rotor 18 only in the direction of oscillation which corresponds to the closing movement of the door, while advantageously in the opposite direction of oscillation for the return to its original position, the actuating lever 12 is oscillatable decoupled from the rotor 18 which, however, remains stationary.

The coupling means comprise a helical spring 35 wound round the cylindrical body 24 of the connecting pin 21 and having one of its ends 36 retained in a recess 37 in the end of the rotor 18 through a cover 44 which engages with a central collar 38 at the same end of the rotor 18 and also acts as a seal against leakage of the grease.

The turns of the helical spring 35 are locked onto the cylindrical body 24 of the connecting pin 21 and allow the transmission of the oscillation to the rotor 18 by friction when the connecting pin 21 oscillates in one direction, and slacken, preventing the transmission of the oscillation to the rotor 18, when the connecting pin 21 oscillates in the opposite direction.

The actuating lever 12 comprises a crosspiece 27 featuring at at least one of its ends a perpendicular arm 28 having a hole 29 for coupling it to the shaped head 23 of the connecting pin 21.

The crosspiece 27 in the case under examination, in which two deceleration devices 11 are provided, has at both its ends corresponding perpendicular arms 28 having holes 29 for coupling to the shaped head 23 of the connecting pin 21 of the corresponding deceleration device 11.

The crosspiece 27 has a principal longitudinal portion 32 of substantially flat conformation comprising the longitudinal edge 31 and a secondary longitudinal portion 33 comprising the longitudinal edge 34, suitably bent back with respect to the principal longitudinal portion 32.

The actuating lever 12 is oscillatable between the initial raised position assumed when the hinge 1 is in the opening position of the door, in which the actuating lever 12 is oriented transversely to the bottom 8 of the box 4, and a final position assumed when the hinge I is in the closing position of the door, in which the actuating lever 12, as a result of the interaction with the arm of the fixed part of the hinge, is located substantially parallel to the bottom 8 of the box 4.

The surface 39 of the housing body 15, suitable for juxtaposition with the outer side of the side wall 9 of the box 4 has, at the side of the area in which the cover 44 is positioned flush, a pin 40 to support the torsion spring 3

The pin 40 is oriented parallel to the axis of oscillation 22 of the actuating lever 12.

The torsion spring 13 has its central part 41 in the shape of a cylindrical helix fitted onto the pin 40, its elastic arm 16 engaged with the longitudinal edge 31 of the crosspiece 27, and its elastic arm 42 opposite to the elastic arm 16 retained against a block 43 which is formed on the surface 39 and partially encircles the pin 40.

The fixing means for the housing body 15 comprise on the surface 39 a hole 45 into which fits the oscillation pin 7 for the hinge 1 and, on the diametrically opposite side to the rotor 18, a dowel 46 which can be fitted by pressure into a small hole 47 in the wall 9 of the box 4.

Inside the box 4, finally, in a position between the crosspiece 27 and the bottom 8 of the box 4, a leaf spring 48 is housed, suitable for assisting the closure of the hinge 1.

The leaf spring 48 has an arm 51 locked by a pin 49 against a window 50 in the bottom 8 of the box 4, and a flexible arm 52 suitable for interacting with a cam 53 carried by the fixed arm of the hinge.

The operation of the deceleration device is briefly as follows.

When the hinge 1 is in the position where the door is fully open, the actuating lever 12 is lifted into its initial position.

Figure 3:
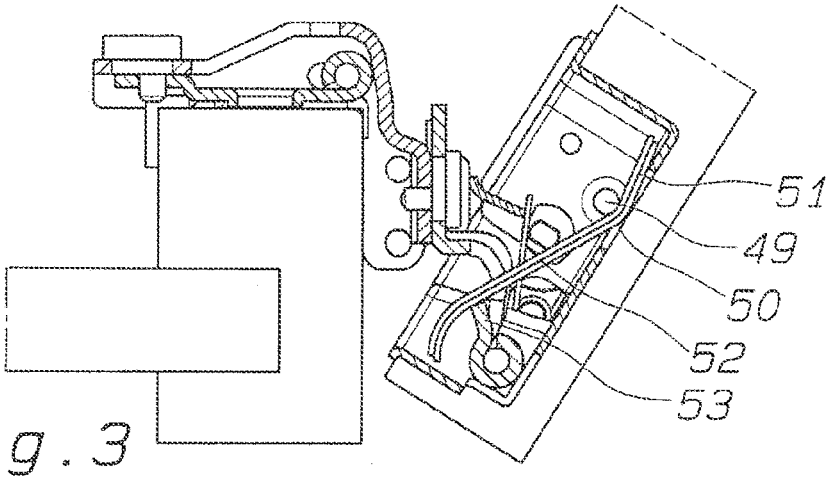
FIG. 3 shows a view in section of the hinge of FIG. 1 in a position where the door is partially open.
Figure 4:
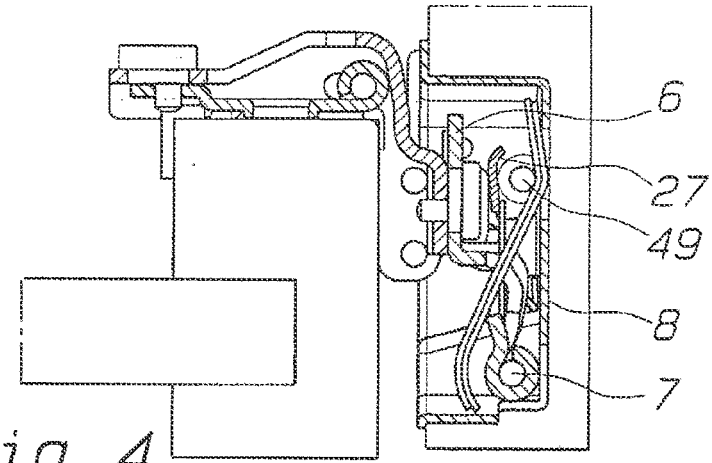
FIG. 4 shows a view in section of the hinge of FIG. 1 in the position where the door is completely closed.
Figure 5:
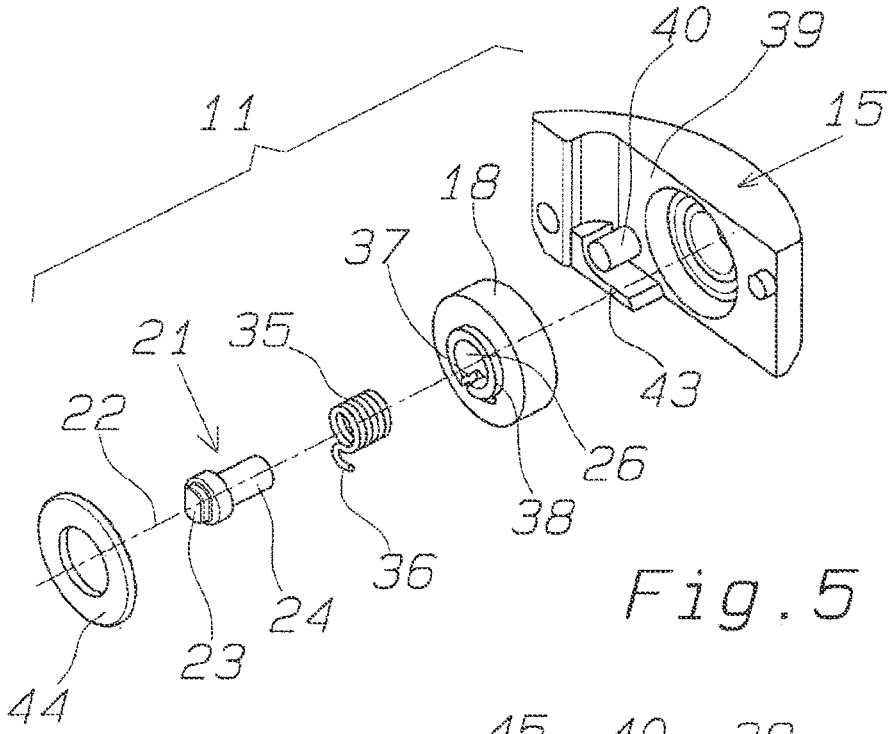
FIG. 5 shows a perspective view of the exploded deceleration device of the hinge of FIG. 1.
Figure 6:
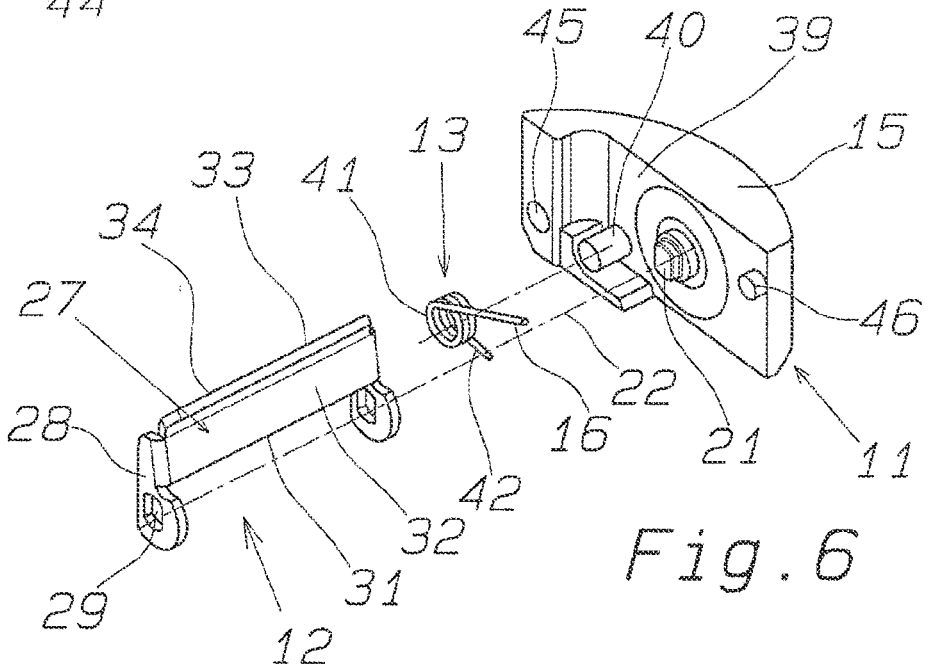
FIG. 6 shows a perspective view of the assembled deceleration device of the hinge of FIG. 1, of the activating lever and of the disassembled elastic return means.
Figure 7:
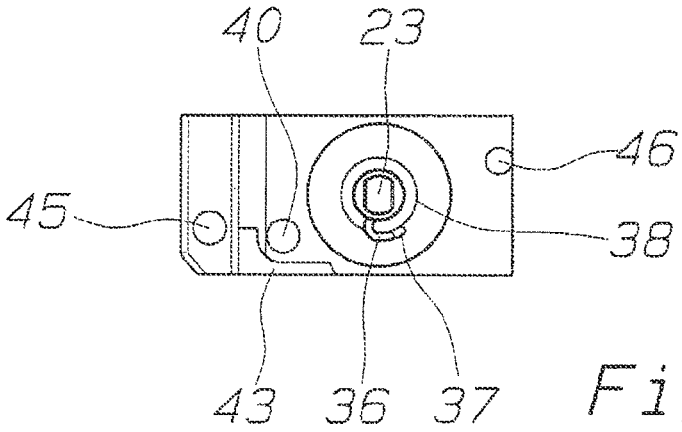
FIG. 7 shows a front view of the assembled deceleration device of the hinge of FIG. 1.
Figure 8:
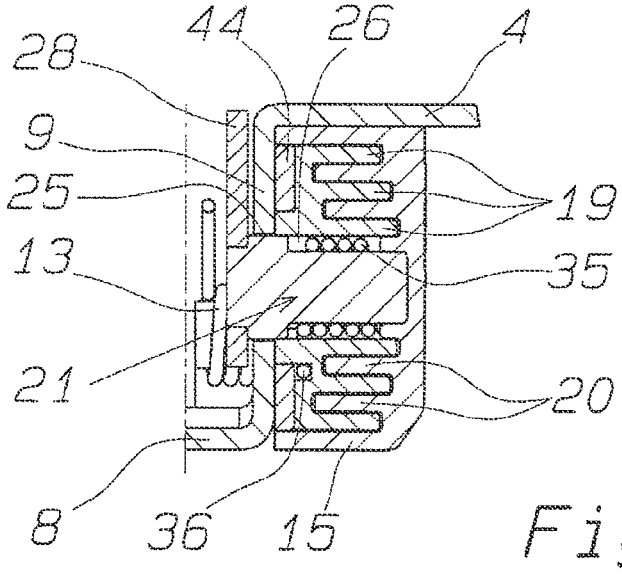
FIG. 8 shows a section of the deceleration device of the hinge of FIG. 1 along a sectioning plane perpendicular to the bottom of the hinge box containing the axis of oscillation of the actuating lever.

As illustrated in FIG. 3, at a certain angle of the oscillation of the door before its closing position, quantifiable for example as an opening angle of the door of approx. 25+35°, the actuating lever 12 is intercepted by the fixed aim of the hinge and starts its oscillation in opposition to the torsion spring 13, which is compressed.

The consequent rotation of the connecting pin 21 causes it to be gripped by the turns of the helical spring 3, which in the resulting configuration makes the rotor 18 integral in oscillation with the connecting pin 21.

The oscillation of the rotor 18 produces the decelerating effect as a result of the viscous friction which develops between the cylindrical friction surfaces 19 and 20.

At the beginning of the door's oscillation in the opening direction the turns of the helical spring 35 slacken and release the connecting pin 21 which, as a result of the stretching of the torsion spring 13, continues its oscillation to bring the actuating lever 12 back to the initial position without also dragging the rotor 18. The opening of the door 1 therefore is absolutely not obstructed by the deceleration device.

It is established in practice that the hinge with the rotating deceleration device according to the invention is particularly advantageous because, with an extremely compact deceleration device external to the hinge box, it ensures a strong braking action which takes place uniformly over a wide angle of oscillation in proximity to the closed position of the door.

The deceleration device makes it possible to optimize the occupation of space within the hinge box, given that it requires the presence inside the hinge box of substantially only the actuating lever and an elastic arm for rearming the actuating lever.

The hinge for furniture thus conceived is susceptible of numerous modifications and variants, all falling within the scope of the inventive concept; all the details are furthermore replaceable by technically equivalent elements.

In practice the materials employed and also the dimensions can be any according to the requirements and the state of the art.

The invention claimed is:

1. A hinge for furniture having at least one deceleration device attached to the outside of the box of the hinge, an actuating lever for the deceleration device, supported in oscillating fashion in the box of the hinge, and elastic return means to bring the actuating lever back to an initial position, characterized in that the deceleration device comprises a housing body which extends peripherally along a side wall of the box and has means for fixing it to said side wall, said elastic return means being located on said housing body outside said box and providing at least one elastic arm which protrudes into the inside of the box through an aperture in the side wall of the box to connect operatively with said actuating lever.

2. The hinge for furniture according to claim 1 characterized in that the deceleration device comprises a rotor operatively connected to the actuating lever, said rotor featuring a plurality of concentric cylindrical friction surfaces engaged and cooperating with corresponding cylindrical friction surfaces of said housing body by means of a viscous fluid interposed between said friction surfaces.

3. The hinge for furniture according to claim 2, characterized in that the deceleration device comprises a connecting pin between said rotor and the actuating lever, said actuating lever, said connecting pin and said rotor having a common axis of oscillation.

4. The hinge for furniture according to claim 3, characterized in that said common axis of oscillation is parallel to the axis of oscillation of the hinge.

5. The hinge for furniture according to claim 3, characterized in that said connecting pin features a shaped head which is prolonged inside the box through a further aperture in said side wall of the box and engages with said actuating lever, and a cylindrical body housed in a cylindrical hole in said rotor concentric with said friction surfaces.

6. The hinge for furniture according to claim 3, characterized in that said actuating lever comprises a crosspiece featuring, at at least one of its ends, a side arm having a hole for coupling it to said connecting pin.

7. The hinge for furniture according to claim 6, characterized in that said actuating lever is oscillatable between said initial position assumed when the hinge is in the open position, in which said actuating lever is oriented transversely to the bottom of the box , and a final position assumed when the hinge is in the closed position, wherein said actuating lever, as a result of the interaction with the fixed arm of the hinge, is located substantially parallel to the bottom of the box.

8. The hinge for furniture according to claim 6, characterized in that inside box is housed, in a position interposed between the crosspiece and the bottom of the box, a leaf spring suitable for assisting the hinge in closure.

9. The hinge for furniture according to claim 3, characterized in that said deceleration device comprises coupling means between said connecting pin and said rotor configured in such a way as to transmit the oscillation from the connecting pin to the rotor only during the oscillation of the hinge in the closing direction.

10. The hinge for furniture according to claim 9, characterized in that said coupling means comprise a helical spring wound round said connecting pin and constrained at one of its ends to said rotor , said helical spring having turns lockable onto the connecting pin or respectively releasable depending on the direction of oscillation.

11. The hinge for furniture according to claim 1, characterized in that said elastic means comprise a torsion spring supported by a pin present in the housing body.

12. The hinge for furniture according to claim 11, characterized in that said torsion spring features said elastic arm engaged with a longitudinal edge of said crosspiece.

13. The hinge for furniture according to claim 1, characterized in that said fixing means comprise a hole for engaging an oscillation pin for the hinge.

14. An article of furniture with front frame characterized by comprising at least one hinge conforming to claim 1.

* * * * *